US006708528B2

(12) United States Patent
Chuang

(10) Patent No.: US 6,708,528 B2
(45) Date of Patent: Mar. 23, 2004

(54) HIGH-ELASTICITY WET SUIT FABRIC

(75) Inventor: Chi-Chou Chuang, Dong Shan Shiang (TW)

(73) Assignee: Shei Chung Shin Industrial Co., Ltd., Yilan County (TW)

( * ) Notice: Subject to any disclaimer, the term of this patent is extended or adjusted under 35 U.S.C. 154(b) by 0 days.

(21) Appl. No.: 10/098,495

(22) Filed: Mar. 18, 2002

(65) Prior Publication Data

US 2003/0172685 A1 Sep. 18, 2003

(51) Int. Cl.[7] ..... B63C 11/04
(52) U.S. Cl. ..... 66/171; 2/2.16
(58) Field of Search ..... 442/315, 318; 66/169 R, 170, 190, 202; 2/2.15, 2.16

(56) References Cited

U.S. PATENT DOCUMENTS 4,274,158 A * 6/1981 Pogorski et al. ..... 2/2.16
5,052,053 A * 10/1991 Peart et al. ..... 2/2.16
5,439,733 A * 8/1995 Paire ..... 428/219
5,614,301 A * 3/1997 Katz ..... 442/315
6,316,373 B1 * 11/2001 Alexander et al. ..... 442/221

* cited by examiner

*Primary Examiner*—Danny Worrell
(74) *Attorney, Agent, or Firm*—Rosenberg, Klein & Lee

(57) ABSTRACT

A high-elasticity wet suit fabric is made of fine count artificial fibers with fine denier counts and elastic yams with high elongation and recovery capabilities, having a texture designed on the basis of elastic features, knitted with a high-speed circular knitting machine and treated in a dyeing and finishing process. Such a high-elasticity wet suit fabric is laminated with an artificial rubber sponge in a laminating process to form a high-elastic wet suit fabric piece. The high-elasticity wet suit fabric of the present invention is better in elasticity than the conventional single-directional and low-elastic wet suit fabric, and capable to improve the comfort, flexibility and elongation of wet suits.

3 Claims, 1 Drawing Sheet

HIGH-ELASTICITY WET SUIT FABRIC

BACKGROUND OF THE INVENTION

1. Field of the Invention

The present invention relates to a high-elasticity wet suit fabric, more particularly to a high-elasticity fabric exclusively for production of wet suits with high elasticity and comfort.

2. The Related Art

Traditionally, the fabric piece for production of wet suits is a one-sided knitted cloth made of 100% nylon and laminated with an artificial rubber sponge. However, since wet suits must be a good fit, the conventional wet suits made of the aforementioned fabric piece, that has only single-directional low elasticity, restricts the movement of the joints of a wearer. In addition, since each part of the human body is different, the constraint needed for individual parts of the wearer's body is variable. However, the conventional wet suits are not capable to meet this demand and make wearers uncomfortable due to poor fit of such wet suits.

The present invention provides a high-elasticity wet suit fabric to alleviate the aforementioned disadvantages of the conventional wet suits.

SUMMARY OF THE INVENTION

An object of the invention is to provide a high-elasticity wet suit fabric with better flexibility for the joints of a wearer's body in comparison with the conventional wet suit fabric pieces and reduce uncomfortable constraint on individual parts of the human body.

The wet suit fabric of the present invention is made of fine count artificial fibers with fine denier counts and elastic yams with high elongation and recovery capabilities, and knitted with a high-speed circular knitting machine. The wet suit fabric made under such conditions has a higher density and elongation than the conventional single-sided knitted cloth made of 100% nylon.

After treated in a dyeing and finishing process, the wet suit fabric is laminated with a layer of artificial rubber sponge to form a fabric piece that is suitable for the production of wet suits and other related products. The wet suits made of such fabric are more fitted, softer and more comfortable.

The present invention will be described in details with reference to the attached drawings, in which:

DETAILED DESCRIPTION OF PREFERRED EMBODIMENT

Figure 1:
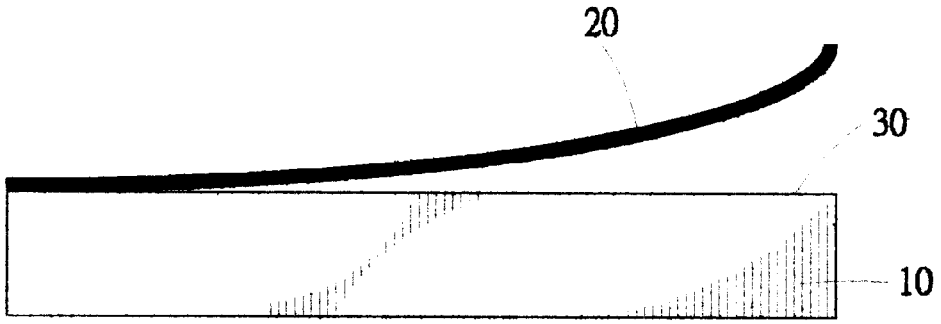
FIG. 1 shows a high-elasticity wet suit fabric of the present invention laminated to one single side.

The method for production of high-elasticity wet suit fabric in accordance with the present invention is divided into two phases: (1) manufacturing high-elasticity wet suit fabric and (2) lamination of artificial rubber sponge.

Phase I: Manufacturing High-Elasticity Wet Suit Fabric

The high-elasticity wet suit fabric of the present invention is made of fine count artificial fibers with fine denier counts and elastic yams with high elongation and recovery capabilities, and has a texture designed on the basis of elastic features. Such a fabric is knitted with a high-speed circular knitting machine and treated in a dyeing and finishing process.

The yarn used in the aforementioned process is made of artificial fibers having a specification below 100 deniers. The fine yarn below 100 deniers is light in weight and capable to reduce absorbency of fabrics. The fabric made under such conditions is thinner and has a better adhesion resistance capability, a smoother surface and an excellent breakage strength. Having been knitted with elastic PU fibers having a specification below 40 deniers and high elongation and recovery capabilities, the wet suit fabric of the present invention has a high elongation capability and a high density as the basis for the high adhesion resistance capability.

In the aforementioned process, a plain knit is designed to give the wet suit fabric a highest elongation capability. The nylon fibers and elastic PU fibers are fed simultaneously with each feeder of the loom. The knitting machine is readjusted to a 100 to 250 gram/yard ratio for the gray cloth and the gray cloth is 54 to 60 inches in the breadth.

Such a fabric is knitted with a loom having a needle size 28 gauge or more, so as to create a high knitting density, reach the expected adhesion resistance level and bring an excellent elongation to laminated finished products. In the knitting process, the tension of the nylon yarns and the elastic PU fibers are appropriately controlled, and a higher tension of the lower fabric is applied to the loom to make the surface of the fabric, having a high content of elastic PU fibers, smooth and produce an excellent touch and a good adhesion resistance effect.

After being dyed, shaped and otherwise treated in the process, the gray cloth of the high-elasticity wet suit fabric is in the 100 to 250 gram/yard ratio and is 54 to 60 inches in the breadth, and the elastic elongation in both the vertical and horizontal directions is more than 200%.

The high-elasticity fabric 20 of the present invention is produced in the aforementioned process.

Phase II: Lamination of Artificial Rubber Sponge

Figure 2:
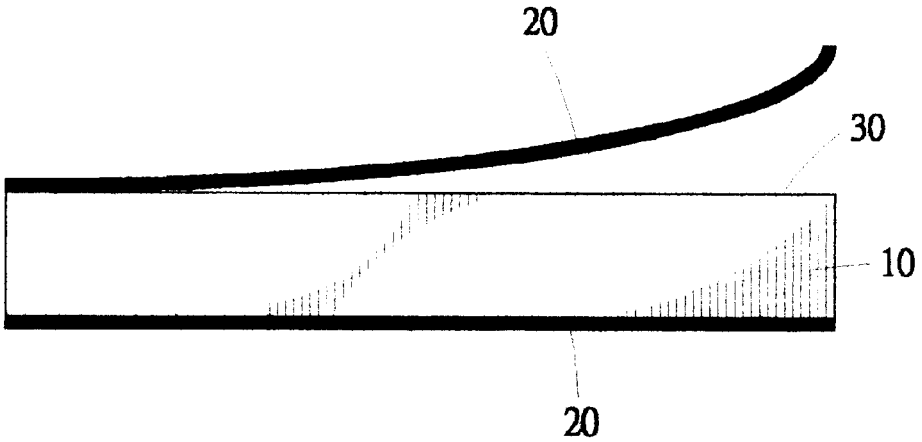
FIG. 2 shows a high-elasticity wet suit fabric of the present invention laminated to both sides.

In a lamination process, the polypropylene wet suit fabric of the present invention 20 is laminated with an artificial rubber sponge 10. The thickness of the artificial rubber sponge 10 can be any of a plurality of thicknesses. As shown in FIGS. 1 and 2, the polypropylene wet suit fabric is capable of being laminated on one single side or both sides with a binder 30, respectively. The laminated polypropylene fabric is then made to be a polypropylene wet suit fabric piece with high elasticity at a special elasticity-processing stage.

The differences between the performances of the present invention and the conventional wet suit fabric are shown in attached Table 1, including bursting strength (kgf/c $m^2$), elongation at specified load (%/4.5 kg), tensile breaking strength (kg), 60% elastic modulus (kg/60%), 120 elastic modulus (kg/120%) and absorbency (%).

As shown in Table 1, the present invention is obviously better in performance than the conventional wet suit fabric, especially in the aspects of elastic elongation, low modulus, low absorbency and high adhesion resistance capability. In the application to professional wet suits, the present invention is more comfortable, flexible and fitted for wearers in comparison with conventional wet suit fabrics, and is capable to provide higher value in industrial applications.

TABLE 1

| Test Item | Direction | | Conventional Wet Suit Fabric | The Present Invention | Tester |
|---|---|---|---|---|---|
| Bursting Strength (kgf/cm$^2$) | #N/A | | 10 | 10 | Mullen Bursting Strength Tester (15 × 15 cm/PC) |
| Elongation at Specified Load (%/4.5 kg) | WARP | Fabric | 120 | greater than 200 | CRE/Grab Method (Fabric & Fabric Piece/Clamp Width 1") |
| | WARP | Fabric Piece | 90 | greater than 180 | |
| | WEFT | Fabric | 170 | greater than 200 | |
| | WEFT | Fabric Piece | 140 | greater than 180 | |
| Tensile Breaking Strength (kg) | WARP | | 28 | 20 | CRE/Strip Method (2.54 × 12 cm/PC) |
| | WEFT | | 21 | 26 | |
| 60% elastic modulus (kg/60%) | WARP | | 1.7 | 0.3 | CRE/Strip Method (2.54 × 12 cm/PC) |
| | WEFT | | 0.9 | 0.3 | |
| 120% Elastic Modulus (kg/120%) | WARP | | — | 0.7 | CRE/Strip Method (2.54 × 12 cm/PC) |
| | WEFT | | 2.6 | 0.6 | |
| Absorbency (Nylon = 100%) | #N/A | | 100% | 71% | Comparative Test (10 × 10 cm/PC) |
| Durability | #N/A | | 50 | greater than 50 | (30 × 20 cm/PC) |

Although the substantial functions and uniqueness of the present invention has been illustrated and described with reference to the preferred embodiment thereof, it should be under stood that it is in no way limited to the details of such embodiment but is capable of numerous modifications within the scope of the appended claims.

What is claimed is:

1. A high-elasticity wet suit fabric made of fine count artificial fibers with fine denier count elastic yarns with high elongation and recovery capabilities, knitted with a high-speed circular knitting machine and treated in a dyeing and finishing process, said high-elastic wet suit fabric being laminated with an artificial rubber sponge in a laminating process, comprising:

a wet suit fabric made of nylon fibers having a fineness less than 100 deniers and knitted with elastic fibers having a fineness less than 40 deniers, a plain knit being designed to maximize an elongation capability of the wet suit fabric, said nylon fibers and elastic fibers being fed simultaneously with respective feeders of a loom, said loom being adjusted to a 100 to 250 gram/yard ratio and said wet suit fabric being 54 to 60 inches in breadth, said wet suit fabric being woven with said loom having needles of at least 28 gauge, after being dyed, shaped and otherwise treated in a process, said wet suit fabric having an elastic elongation in both vertical and horizontal directions being more than 200%; and an artificial rubber sponge having a predetermined thickness on which the high-elastic fabric is laminated, a binder being applied between said wet suit fabric and said artificial rubber sponge to form a laminated high-elasticity fabric piece.

2. The high-elasticity wet suit fabric as claimed in claim 1, wherein said wet suit fabric is laminated to one single side of said artificial rubber sponge.

3. The high-elasticity wet suit fabric as claimed in claim 1, wherein said wet suit fabric is laminated to both front and reverse sides of said artificial rubber sponge.

* * * * *